United States Patent [19]

Suttles et al.

[11] Patent Number: 4,773,543

[45] Date of Patent: Sep. 27, 1988

[54] CIGARETTE MERCHANDIZING DEVICE

[75] Inventors: J. Marshall Suttles; Jerry R. Stafford, both of Elberton, Ga.

[73] Assignee: Royston Corporation, Royston, Ga.

[21] Appl. No.: 35,886

[22] Filed: Apr. 8, 1987

[51] Int. Cl.[4] ..... A47F 7/00

[52] U.S. Cl. ..... 211/59.2; 312/42

[58] Field of Search ..... 211/59.2, 59.4, 49.1; 312/42, 60, 72, 73, 35; 221/92, 194, 6, 312 R; 248/542

[56] References Cited

U.S. PATENT DOCUMENTS

| | | | |
|---|---|---|---|
| 2,723,036 | 11/1955 | Temple | 211/59.2 |
| 3,008,584 | 11/1961 | Carson | 211/49 |
| 3,265,246 | 8/1966 | Messenger | 221/283 |
| 3,560,067 | 2/1971 | Stieg | 312/42 |
| 3,858,757 | 1/1975 | Langdon, Jr. | 221/92 |
| 3,993,372 | 11/1976 | Mihos | 312/42 |
| 4,092,055 | 5/1978 | Wallenwaber | 312/42 X |
| 4,387,810 | 6/1983 | Crosslen | 211/49 |
| 4,396,237 | 8/1983 | Henry | 312/42 |
| 4,478,338 | 10/1984 | Crosslen | 211/490 |
| 4,498,714 | 2/1985 | Wiese | 312/312 |
| 4,566,596 | 1/1986 | Hennig | 312/42 |
| 4,682,826 | 7/1987 | Mestdagh | 312/42 |

*Primary Examiner*—J. Franklin Foss
*Assistant Examiner*—Sarah A. Lechok Eley
*Attorney, Agent, or Firm*—Howson & Howson

[57] ABSTRACT

An overhead cigarette merchandizing device for check-out counter use comprises a plurality of lowerable wire cages, each mounted on a guide wire in a frame, and each cage having a resilient slide movable vertically along the guide wire. Each cage is held in its uppermost position by engagement of its slide with an enlargement on the guide wire. By exerting a sufficient manual downward force, the cage can be lowered for loading. Front and rear horizontal rods of the frame, and side wires on the frame located near the lower end of each cage prevent the cage from swinging about the point at which its slide engages the enlargement on the guide wire. The frame is supported by engagement of ends of its horizontal rods in end plates, which are secured to an inverted U-shaped cover in such a way that the ends of the rods are hidden in a space between the end plates and the side walls of the cover. The number of packs remaining in a column is determined by a gauge which pushes upwardly against the packs through an opening in the bottom of the cage until the packs engage a stop at the upper end of the cage. Markings on the gauge are read against a fixed point on the cage.

12 Claims, 3 Drawing Sheets

FIG. 1
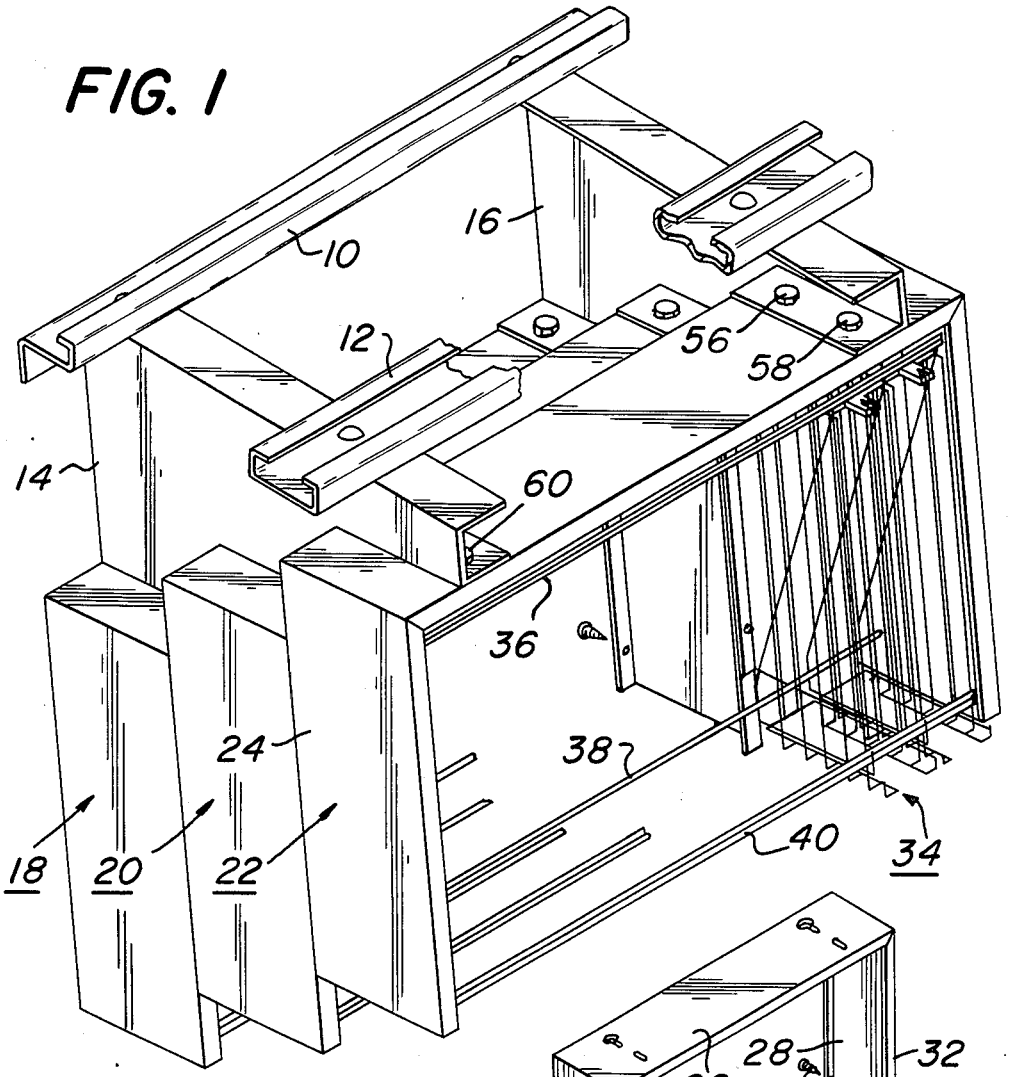
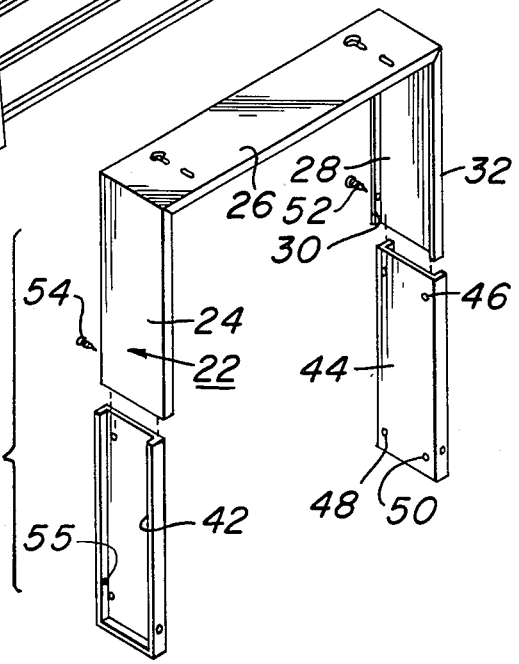
FIG. 2

FIG. 3
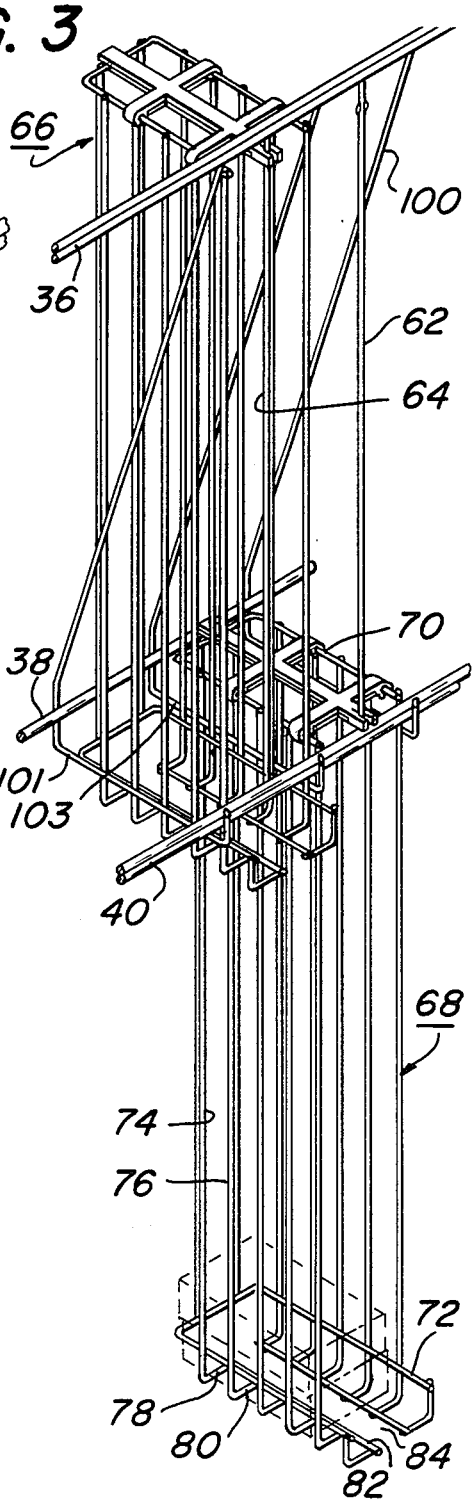
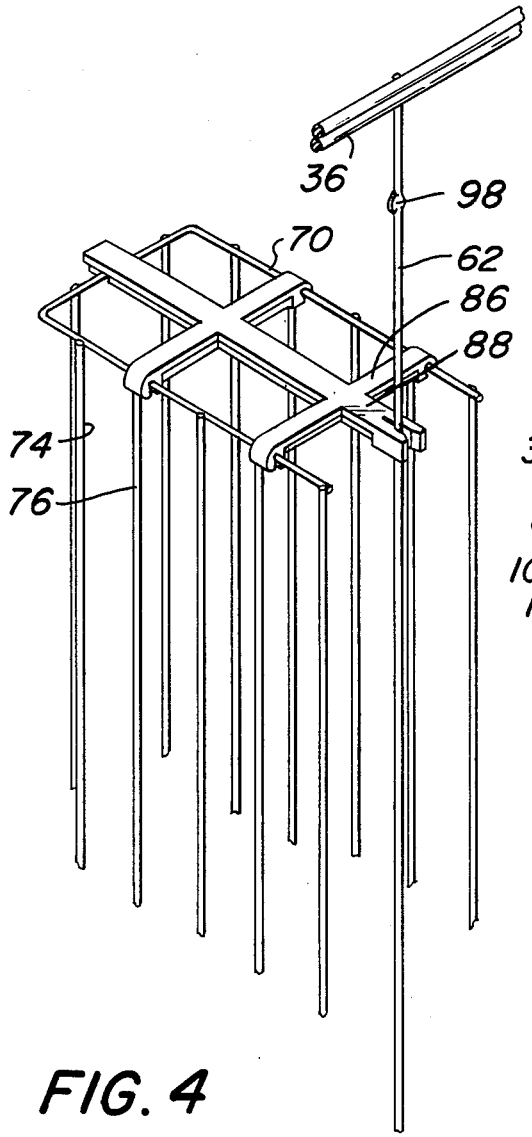
FIG. 4

CIGARETTE MERCHANDIZING DEVICE

BRIEF SUMMARY OF THE INVENTION

This invention relates in general to merchandising devices, and more specifically to an overhead merchandising device of the type used to dispense cigarette packs to the cashier at the checkout counter of a retail store.

Numerous different overhead cigarette dispensers have been proposed. In most cases, the cigarette dispenser holds the packs in columns, there being one column for each brand of cigarette. Packs are removed manually from the bottom of a column by sliding them forward. As a column is depleted, it must be replenished. Since the top of the column is usually out of reach, it is common to provide for downward movement of groups of columns so that they can be more easily refilled.

Units consisting of large groups of columns may require replenishment of some columns, even though other columns are filled or nearly filled. These units can be difficult to raise and lower because of their weight. Reducing the number of columns in a lowerable unit makes the unit more easily manageable, but adds to the overall complexity of the apparatus.

Another problem with prior cigarette merchandisers was that it was not easy to make them available in a variety of sizes to accommodate different numbers of columns nor to make optimum use of available overhead space. Providing dispensers in many different sizes required expensive tooling, and maintenance of a large inventory of each of many different dispenser components.

The principal object of this invention is to overcome the foregoing problems by providing a simple and easily operated cigarette dispenser in which individual columns can be lowered for loading, and which can be made inexpensively in a wide variety of sizes. Further objects of the invention include maximum visibility of the product contained in the cigarette dispenser, reduction of the cost of manufacture and on site assembly, a pleasing appearance, and simple and rapid determination of the number of packs remaining in each column.

The cigarette merchandising device in accordance with the invention comprises a plurality of vertically extending guide wires, means supporting the guide wires in spaced parallel relationship to one another, and a plurality of pack-supporting sleeves, there being one pack-supporting sleeve for each guide wire. Each sleeve is in the form of a vertically elongated wire cage having means at its lower end for engaging the lowermost pack in a stack and supporting the stack against downward vertical movement. The sleeve also includes vertical wall means for maintaining the packs of the stack in vertical alignment with one another. Each pack-supporting sleeve has slide means fixed to it near its upper end. The slide includes wire-engaging means slidably embracing one of the guide wires whereby the sleeve can be moved between a raised position and a lowered position in the direction of the guide wire. Each guide wire has an enlargement near, but spaced below, its upper end. The wire-engaging means of each slide is resilient, whereby it can pass over the enlargement of the guide wire which it embraces as the slide is moved past the enlargement in either direction. The enlargements are of sufficient size, and the wire-engaging means has sufficient rigidity, that each pack-supporting sleeve can be held in its raised position against downward movement, while containing a load, by engagement of its slide means with the enlargement of the wire embraced by the wire-engaging means of the slide means.

Each sleeve of the assembly can be lowered by manually pulling it downwardly with a force sufficient to cause the slide to pass over the enlargement of its guide wire. The wire cage sleeve is preferably formed so that its front is open. Therefore, when the sleeve is lowered, packs can be inserted in groups through the front opening. When the sleeve is manually returned to its upper position, the slide passes over the enlargement of the guide wire, and the sleeve is supported by engagement of the slide with the upper part of the enlargement. The guide wire is preferably positioned so that, when the sleeve is in its upper position, the guide wire itself serves as a barrier preventing cigarette packs from falling out through the front opening of the sleeve.

With the foregoing arrangement, each sleeve is supported against downward vertical movement by engagement of its slide with a guide wire enlargement essentially at a single point. The sleeve is prevented from swinging about this point by rigid horizontal members located on the front and back of each sleeve, and by front to back rigid members on both sides of each sleeve. A third horizontal rigid member extends across, and is connected to the upper ends of, the guide wires.

The horizontal rigid members form part of a carrier assembly. The ends of at least two of the horizontal rigid members extend through holes in left and right hand sheet metal end caps. The end caps are located between flanged side walls of an inverted U-shaped cover, and fastened to the side walls. The ends of the horizontal rigid members are hidden between the end caps and the side walls of the cover. The cover is secured to an overhead bracket. With this arrangement, the entire dispenser is held in place using a minimum number of fasteners.

The number of packs in each column is determined by the use of a pack gauge consisting of an elongated bar having a pack-engaging member attached at one of its ends, and markings along its length. A stop is provided at the top of each sleeve for engagement by the uppermost pack, and the bottom of each sleeve is partly open to permit passage of the bar and pack-engaging member into the sleeve through the bottom. As the packs remaining in the sleeve are pushed upwardly against the stop by the bar, the number of packs remaining (or the number of packs needed to fill the sleeve) can be determined by reading the markings against a fixed point on the sleeve.

Further objects, advantages and details of the invention will be apparent from the following detailed description when read in conjunction with the drawings.

BRIEF DESCRIPTION OF THE DRAWINGS

FIG. 1 is a partially broken away perspective view of a cigarette merchandiser in accordance with the invention;

FIG. 2 is an exploded view showing the inverted U-shaped cover of the merchandising device and a pair of end caps which support the sleeve and guide assembly in the space between the side walls of the cover;

FIG. 3 is a fragmentary perspective view showing part of a guide assembly, and two sleeves mounted thereon, one sleeve being in its uppermost position, and the other sleeve being in its lowered position;

FIG. 4 is a fragmentary perspective view showing details of the engagement of a slide at one end of a sleeve with a guide wire;

DETAILED DESCRIPTION

Figure 5:
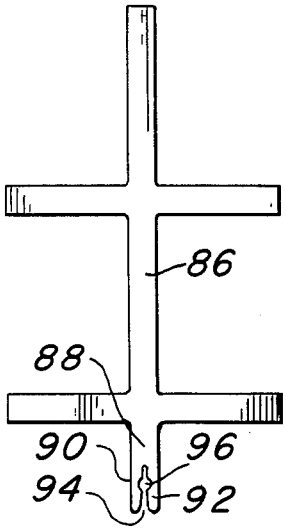
FIG. 5 is a top plan view of a typical slide.

As shown in FIG. 1, the merchandising device of the invention comprises a pair of overhead beams 10 and 12, which can be attached to a ceiling, or to vertical supports. Brackets 14 and 16 are secured to the overhead beams. The underside of each bracket has a series of flanges in a stepped configuration. The pair of brackets are in opposed, spaced, parallel relationship, and support inverted U-shaped sheet metal covers 18, 20 and 22 on their respective steps. Thus, a rear cover 18 is somewhat lower than intermediate cover 20 which is in turn somewhat lower than front cover 22. These covers are preferably identical to one another.

The flanges of the brackets can slope downwardly from front to rear so that the cigarette dispenser supported by the brackets tilts rearwardly by a few degrees.

Cover 22, as more clearly seen in FIG. 2, comprises a left side wall 24, a top wall 26, and a right side wall 28. The rear and front edges of side wall 28 have inwardly projecting flanges 30 and 32 respectively. The top wall and the left side wall have similar flanges.

A sleeve and guide assembly, generally indicated at 34 in FIG. 1, is located underneath the top of cover 22, and between the side walls thereof. The sleeve and guide assembly comprises a stationary frame having horizontally extending rigid members 36, 38 and 40. Member 38 is a single heavy gauge rod. Each of members 36 and 40 consists of two rods lying against each other.

FIG. 2 shows end caps 42 and 44, which are in the form of sheet metal members of a size to fit between the flanges of the cover. Each end cap is flanged at its vertical and lower edges and has four holes, one near each corner, three of which, on each end cap, receive horizontal rigid members of the sleeve and guide assembly. Four holes are provided so that the end caps can be interchangeable. End cap 42, for example, has through holes 46, 48 and 50 designed to receive ends of horizontal rigid members 36, 38 and 40 respectively. End cap 44 is provided with similar holes for receiving the opposite ends of the horizontal members.

With the horizontal elements of the sleeve and guide assembly extending through the holes of the end caps, the entire sleeve and guide assembly can be supported against both translation and rotation by securing each end cap to a side wall of the cover by a single sheet metal screw. Thus, sheet metal screw 52 extends through a hole in a flange at the rear vertical edge of side wall 28, and into a hole (not shown) in the rear vertical flange of end cap 44. End cap 42 is similarly attached by a single sheet metal screw 54 to side wall 24 of the cover, the screw extending through a hole in the rear vertical flange of side wall 24 and into hole 55 in the rear vertical flange of end cap 42. Holes similar to hole 55 are provided in both vertical flanges of each end cap, so that the end caps are symmetrical and can be interchanged.

The sleeve and guide assembly comprises a plurality of vertically extending guide wires, and an equal number of vertically movable sleeves, each being in the form of a wire cage. A sleeve and guide assembly typically comprises ten sleeves. However, the length of the assembly, and the number of sleeves therein can easily be varied to accommodate inverted U-shaped covers of different widths.

FIG. 3 shows part of a sleeve and guide assembly in which two parallel, vertically extending guide wires 62 and 64 are secured at their upper ends to horizontal member 36, and at their lower ends to horizontal member 40. Sleeves 66 and 68 are movable vertically on guide wires 64 and 62 respectively.

As shown in FIG. 3, sleeve 68 comprises a horizontal U-shaped wire 70 at its upper end, and a horizontal U-shaped wire 72 near its lower end. These U-shaped wires are connected by vertically extending wires at the rear and at both sides to form a vertically elongated cage having a rear wall, left and right side walls, and an open front. The size of the cage is such as to accommodate a column of cigarette packs, and to support the contained columns of packs against falling to the side or rearwardly. Two of the wires of the left side wall are indicated at 74 and 76 respectively. The lower ends of these wires are bent inwardly at 78 and 80 and secured to a horizontal rearwardly extending wire 82. The remaining vertical wires in the left side are similarly bent inwardly and attached to wire 82. The vertical wires on the right side of the sleeve are similarly bent inwardly and attached to a rearwardly extending horizontal wire which is spaced from wire 82 so as to form a slot 84. This slot 84 enables the lowermost pack in a sleeve to be easily removed manually, and also accommodates the gauge which will be described subsequently.

FIG. 4 shows a stop 86, which is preferably a molded polyamide or similar material having a comparatively hard, but somewhat resilient character. Stop 86 has an elongated central section having two sets of laterally extending arms. The arms and the rear end of the central section have keyhole-shaped slots which snap over U-shaped wire 70, so that the stop is firmly secured to the sleeve. Forward part 88 of the central section of the stop projects forwardly, and is bifurcated to embrace guide wire 62. As shown in FIG. 5, part 88 has two fingers 90 and 92 on both sides of a slot having a tapered entry portion 94, and a partially cylindrical wire-grasping enlargement 96. The open slot makes it possible to engage the stop with a guide wire easily, even though the guide wire has horizontal members 36 and 40 at its upper and lower ends. The slot extends somewhat to the rear of enlargement 96 to allow the fingers to spread apart when pushed over a guide wire so that the guide wire can be received in enlargement 96 in the manner depicted in FIG. 4.

When a sleeve is in its lowered position, as shown in FIG. 3, the front of the stop engages horizontal member 40. The rear of the stop extends slightly behind the U-shaped wire at the upper end of the sleeve, and engages horizontal member 38. Thus, the lowered sleeve is supported at the front and rear of its upper end by members 40 and 38 respectively.

As shown in FIG. 4, a short distance below horizontal member 36, guide wire 62 has a small enlargement 98, formed by stamping. Enlargement 98 is such that the bifurcated stop can pass over it when the sleeve is manually forced upwardly or downwardly. However, enlargement 98 is of sufficient size, and the material of the stop is of sufficient rigidity, that the sleeve will not fall under a normal load, e.g. the weight of the sleeve plus the weight of twenty cigarette packs. Normally, therefore, the sleeve is supported by engagement of the enlargement and the stop in the manner of sleeve 66, shown in FIG. 3.

Figure 6:
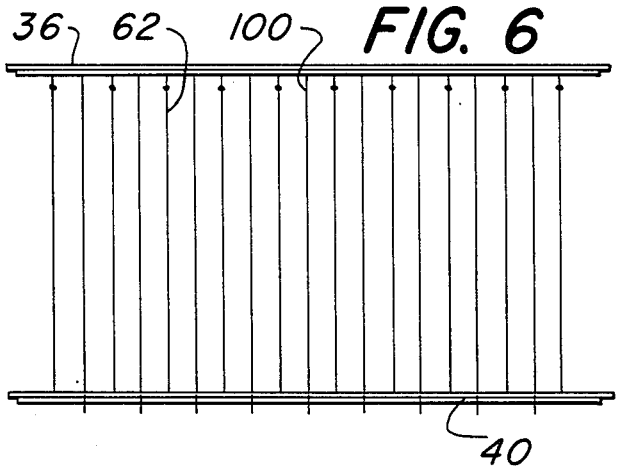
FIG. 6 is a front elevation of a carrier assembly in accordance with the invention.
Figure 7:
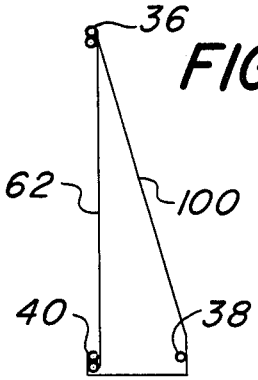
FIG. 7 is a right side elevation of the carrier assembly of FIG. 6.

Referring to FIGS. 6 and 7, the carrier comprises a series of guide wires, including wire 62, extending vertically from horizontal transverse member 36 to member 40. A wire 100 extends downwardly and rearwardly from horizontal member 36, around rear horizontal member 38, and forwardly toward horizontal member 40. There is a wire corresponding to wire 100 between each adjacent pair of wires corresponding to guide wire 62. The horizontal portions of wire extending front to rear between members 40 and 38 cooperate with members 40 and 38 to provide rectangular frames preventing the sleeves from swinging about the points at which the they are supported by the enlargements on the guide wires. For example, referring to FIG. 3, sleeve 66 is prevented from swinging forwardly and rearwardly by members 40 and 38 respectively, and is prevented from swinging from side to side by wire sections 101 and 103.

Figure 8:
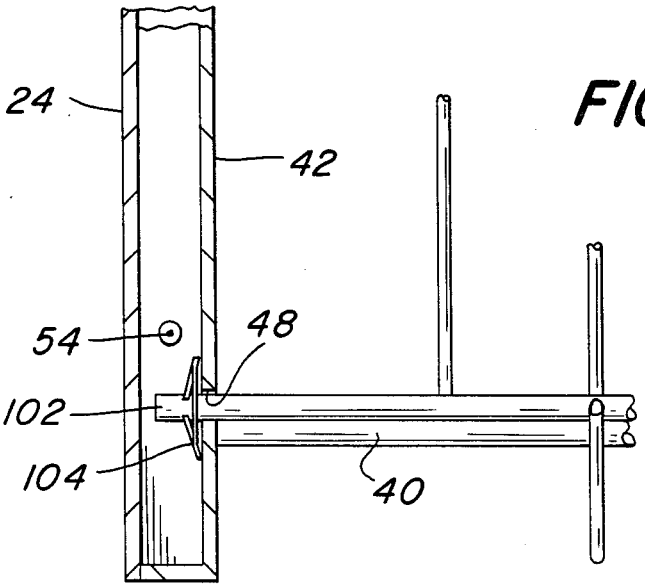
FIG. 8 is a fragmentary vertical section through a left side wall of one of the covers of the merchandising device, showing the relationship between the end cap and the side wall, and the manner in which one of the horizontal members of the carrier is held by the end cap.

FIG. 8 shows horizontal member 40 extending through opening 48 in end cap 42. Horizontal member 40 consists of two parallel rods, the upper one of which extends a short distance beyond the end of the lower one. A speed nut 104 is secured to the projecting end 102 of the upper rod, preventing it from pulling out of hole 50. End 102 of the upper rod, and the speed nut are hidden from view in the space between end cap 42 and side wall 24. End cap 42 is secured to side wall 24 by sheet metal screw 54.

Figure 9:
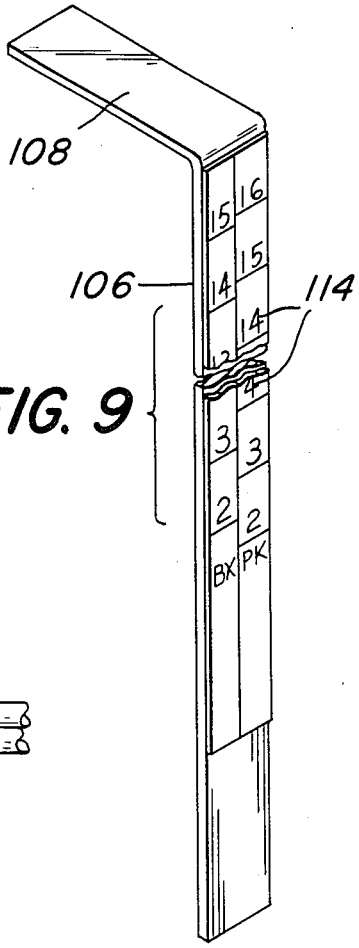
FIG. 9 is a partially broken away perspective view of the pack gauge.

The gauge of FIG. 9 comprises an L-shaped bar 106 which is slightly longer than the height of a sleeve, and which has at its upper end a pack-engaging plate 108. The vertical portion of the bar has a decal with markings which are preferably numbers located at intervals equal to the thickness of the cigarette pack. Preferably, there are two sets of markings, side-by-side, one set being for soft packs, and the other being for boxes, which are slightly thicker than soft packs. When the gauge is inserted through slot 84 (FIG. 3) and used to push the column of cigarettes packs in the sleeve upwardly against the stop at the upper end of the sleeve (corresponding to stop 86 in FIGS. 4 and 5), the marking adjacent to the bottom opening of the sleeve indicates the number of packs remaining in the sleeve. The gauge makes it possible to take inventory rapidly, without lowering the sleeves.

It will be apparent from the foregoing that the merchandising device of the invention has numerous advantages particularly in that it is simple to manufacture and install, and easy to operate, and in that it is light in weight and provides high visibility for the product. The invention also has the significant advantage that it can be produced in various widths without the need for a large inventory of parts. The same overhead brackets, sleeves and end caps can be used regardless of the width of the merchandiser. The carrier of FIGS. 6 and 7 can easily be produced in any desired length, and the cover can easily be produced in any desired size.

Various modifications can be made to the invention without departing from its scope as defined in the following claims.

We claim:

1. A merchandising device for cigarette packs and the like comprising:

a plurality of vertically extending guide wires;

carrier means supporting said guide wires in spaced parallel relationship to one another; and a plurality of pack-supporting sleeves, there being one pack-supporting sleeve for each of said guide wires;

wherein:

each pack-supporting sleeve is in the form of a vertically elongated wire cage having means at its lower end for engaging the lowermost pack in a stack and supporting said stack against downward vertical movement, and vertical wall means for maintaining the packs of said stack in vertical alignment with one another;

each pack-supporting sleeve has slide means fixed to it near its upper end and said slide means includes wire-engaging means slidably embracing one of said guide wires, whereby the sleeve can be moved between a raised position and a lowered position in the direction of the guide wire;

each guide wire has an enlargement near, but spaced below, its upper end;

the wire-engaging means of each of said slide means is resilient, whereby it can pass over the enlargement of the guide wire which it embraces as the slide means is moved past the enlargement in either direction; and the enlargements of the guide wires are of sufficient size and the wire-engaging means has sufficient rigidity that each pack-supporting sleeve can be held in its raised position against downward movement, while containing a load, by engagement of its slide means with the enlargement of the wire embraced by the wire-engaging means of the slide means.

2. A merchandising device according to claim 1 in which the vertical wall means of each pack-supporting sleeve comprises a back wall and two side walls, in which each pack-supporting sleeve has an open front, and in which the guide wires are positioned so that one of said guide wires extends along the open front of each pack-supporting sleeve when the pack-supporting sleeves are in their raised positions.

3. A merchandising device according to claim 1 in which the wire-engaging means of each slide comprises a bifurcated element having a pair of resilient fingers with a slot between them, the slot being open at one end of the element in order to engage a guide wire.

4. A merchandising device according to claim 1 in which the wire-engaging means of each slide comprises a bifurcated element having a pair of resilient fingers with a slot between them, the slot being open at one end to engage a guide wire, and being closed at its opposite end, and having an enlarged portion intermediate said ends, the guide wire embraced by each wire-engaging means being located in the enlarged portion of the slot therein.

5. A merchandising device according to claim 1 in which each pack-supporting sleeve has a front and a back, and in which the means supporting said guide wires in spaced parallel relationship to one another comprises a first rigid horizontal member connected to the guide wires and extending across the lower ends thereof in front of the fronts of the pack-supporting sleeves, and a second rigid horizontal member extending behind the backs of the pack-supporting sleeves, whereby the first and second rigid members support the pack-supporting sleeves against forward and rearward swinging movement about the points at which the wire-engaging portions of their slides are engaged with the guide wires.

6. A merchandising device according to claim 5 in which the front of each pack-supporting sleeve is open, and the enlargements are positioned on the guide wires and the slide means are positioned on the sleeves so that when the sleeves are in their raised positions with their slide means engaging the enlargements, one of said guide wires extends along the open front of each sleeve, and the means on each sleeve for supporting the stack therein against downward movement is spaced below the lower end of the guide wire engaged by the slide means of the sleeve and also below the first rigid horizontal member, whereby a clearance is provided for removal of the lowermost pack in a stack through the open front of the sleeve.

7. A merchandising device according to claim 1 in which each pack-supporting sleeve has a front, a back and two sides, and in which the means supporting said guide wires in spaced parallel relationship to one another comprises a first rigid horizontal member connected to the guide wires and extending across the lower ends thereof in front of the fronts of the pack-supporting sleeves, a second rigid horizontal member extending behind the backs of the pack-supporting sleeves, and a plurality of front-to-back rigid members, each extending from the first rigid member to the second rigid member, there being front-to-back rigid members between every pair of adjacent guide wires whereby the first, second and front-to-back rigid members support the pack-supporting sleeves against swinging movement about the points at which the wire-engaging portions of their slides are engaged with the guide wires.

8. A merchandising device according to claim 1 in which the carrier means supporting said guide wires in spaced relationship to one another comprises at least two parallel rigid horizontal members spaced from each other, each of said members having a left end and a right end; the merchandising device having left and right substantially planar sheets located in substantially vertical planes respectively on the left and right sides of the guide wire supporting means, the sheets having through holes, each of the left ends of the horizontal members extending through one of the through holes in the left sheet and each of the right ends of the horizontal members extending through one of the through holes in the right sheet, whereby the carrier means is held by the sheets against translation perpendicular to the directions of the horizontal members and against rotation about axes parallel to said directions; the merchandising device also having a support and cover means attached to said support, said cover means having a first panel located to the left of the left sheet and a second panel located to the right of the right sheet, said panels covering at least the portions of the horizontal members extending outwardly beyond said through holes, and said sheets being rigidly attached to the cover means.

9. A merchandizing device according to claim 1 in which the carrier means supporting said guide wires in spaced relationship to one another comprises at least two rigid horizontal members connected to the guide wires respectively adjacent to the upper and lower ends thereof, each of said members having a left end and a right end; the merchandising device having left and right substantially planar sheets located in substantially vertical planes respectively on the left and right sides of the guide wire supporting means, the sheets having through holes, each of the left ends of the horizontal members extending through one of the through holes in the left sheet and each of the right ends of the horizontal members extending through one of the through holes in the right sheet, whereby the carrier is held by the sheets against translation perpendicular to the directions of the horizontal members and against rotation about axes parallel to said directions; the merchandising device also having a support and cover means attached to said support, said cover means having a first panel located to the left of the left sheet and a second panel located to the right of the right sheet, said panels covering at least the portions of the horizontal members extending outwardly beyond said through holes, and said sheets being rigidly attached to the cover means.

10. A merchandising device according to claim 1 in which said means at the lower end of each sleeve has an opening and the merchandising device has stop means located at the top of each pack-supporting sleeve, and includes gauge means comprising an elongated bar having a pack-engaging member at one of its ends, the bar and pack-engaging member being of a size such that they can move through said opening, and the bar has a series of markings along its length, whereby, when the cigarette packs in a sleeve are pushed upwardly against the stop means at the top of the sleeve by the pack-engaging member, the number of packs in the sleeve can be determined by the relationship of the markings to a fixed reference point on the sleeve.

11. A merchandising device for cigarette packs and the like comprising a plurality of vertically elongated pack-supporting sleeves, each having means at its lower end for engaging the lowermost pack in a stack and supporting said stack against downward vertical movement, and vertical wall means for maintaining the packs of said stack in vertical alignment with one another, in which said means at the lower end of each sleeve has an opening and the merchandising device has stop means located at the top of each pack-supporting sleeve, and includes gauge means comprising an elongated bar having a pack-engaging member at one of its ends, the bar and pack-engaging member being of a size such that they can move through said opening, and the bar has a series of markings along its length, whereby, when the cigarette packs in a sleeve are pushed upwardly against the stop means at the top of the sleeve by the pack-engaging member, the number of packs in the sleeve can be determined by the relationship of the markings to a fixed reference point on the sleeve.

12. A merchandising device for cigarette packs comprising means defining a plurality of pack-supporting columns, and carrier means for supporting said pack-supporting columns, in which the carrier means comprises at least two parallel rigid horizontal members spaced from each other, each of said members having a left end and a right end; the merchandising device having left and right substantially planar sheets located in substantially vertical planes respectively on the left and right sides of the carrier means, the sheets having through holes, each of the left ends of the horizontal members extending through one of the through holes in the left sheet and each of the right ends of the horizontal members extending through one of the through holes in the right sheet, whereby the carrier means is held by the sheets against translation perpendicular to the directions of the horizontal members and against rotation about axes parallel to said directions; the merchandising device also having a support and cover means attached to said support, said cover means having a first panel located to the left of the left sheet and a second panel located to the right of the right sheet, said panels covering at least the portions of the horizontal members extending outwardly beyond said through holes, and said sheets being rigidly attached to the cover means.

* * * * *